US010971875B2

(12) United States Patent
Chin

(10) Patent No.: US 10,971,875 B2
(45) Date of Patent: Apr. 6, 2021

(54) APPARATUS AND METHOD OF SECURING ADAPTERS TO A MOBILE DEVICE

(71) Applicant: Kien Hoe Daniel Chin, Fremont, CA (US)

(72) Inventor: Kien Hoe Daniel Chin, Fremont, CA (US)

( * ) Notice: Subject to any disclaimer, the term of this patent is extended or adjusted under 35 U.S.C. 154(b) by 0 days.

(21) Appl. No.: 16/672,418

(22) Filed: Nov. 1, 2019

(65) Prior Publication Data

US 2020/0144776 A1 May 7, 2020

Related U.S. Application Data

(60) Provisional application No. 62/755,538, filed on Nov. 4, 2018.

(51) Int. Cl.
*H01R 33/92* (2006.01)
*H01R 43/26* (2006.01)

(52) U.S. Cl.
CPC ..... *H01R 33/92* (2013.01); *H01R 43/26* (2013.01)

(58) Field of Classification Search
None
See application file for complete search history.

(56) References Cited

U.S. PATENT DOCUMENTS 6,193,546 B1 * 2/2001 Sadler ..... H04M 1/04 439/534
8,113,873 B1 * 2/2012 Sarraf ..... H01R 13/6315 439/533
9,160,826 B2 * 10/2015 Kim ..... H04M 1/04
2006/0141856 A1 * 6/2006 Chen ..... H04B 1/3888 439/527
2007/0047198 A1 * 3/2007 Crooijmans ..... G06F 1/1632 361/679.41
2007/0263348 A1 * 11/2007 Rutledge ..... G06F 1/263 361/679.01
2007/0291973 A1 * 12/2007 Neu ..... H01R 33/00 381/334
2010/0102777 A1 * 4/2010 Sa ..... H02J 7/0044 320/115
2013/0002193 A1 * 1/2013 Aldana ..... G06F 1/1632 320/107
2013/0005179 A1 * 1/2013 Aldana ..... H01R 13/6315 439/529
2013/0217448 A1 * 8/2013 Kim ..... G06F 1/1632 455/575.1
2019/0312385 A1 * 10/2019 Shain ..... H04N 5/232

* cited by examiner

*Primary Examiner* — Oscar C Jimenez
(74) *Attorney, Agent, or Firm* — Alexander Chen, Esq.

(57) ABSTRACT

A novel apparatus for securing a USB hub to a mobile device that comprises a vertical plate; a top horizontal plate and a bottom horizontal plate; the vertical plate and the top and bottom horizontal plates are fused together to form an elongated channel; three through holes on the vertical plate; and at least two screws for attaching said apparatus to a side of a mobile device.

14 Claims, 15 Drawing Sheets

APPARATUS AND METHOD OF SECURING ADAPTERS TO A MOBILE DEVICE

INCORPORATION BY REFERENCE

This application claims the benefit of priority under 35 U.S.C. 119(e) to the filing date of U.S. provisional patent application No. 62/755,538, entitled "Apparatus and Method of Securing Adapters to a mobile device," which was filed on Nov. 4, 2018 and which are incorporated herein by reference in their entirety.

FIELD OF INVENTION

The present invention relates to apparatuses and methods of securing adapters to a mobile device, specifically, with a quick attachment method without the need for tools.

BACKGROUND OF THE INVENTION

The benefits of mobile devices such as light, compact, less power consumption, etc. come with some tradeoffs. For examples, traditional internal PC components, such as an optical drive or secondary large hard drive, must be externally connected because the mobile devices are so compact that they have no room for the components, and these external components, in turn, require external power supplies. For offices away from home or base offices, people need to carry additional external devices, power supplies, and cables. Obviously, the longer the list of things to pack, the less stress-free the trip is.

Not only the compact mobile devices have no room for expanded components, but they do not have room for too many connector sockets. To remedy the situation, adapter hubs that have multiple sockets of different purposes, such as USB for data transfer, USB for charging, HDMI for external monitor, etc., are invented. However, past hubs based on USB 2.0 or 3.0 specifications only provide up to 2.5 watts of power, just enough to charge a phone or tablet but taking hours, or only transfer up to 400 MB of data per second. Moreover, USB 2.0 is only half duplex, which does not allow full speed for simultaneous incoming and outgoing data transfers. The limitations limit what the hub can provide and, thus, their sizes somewhat. But they did not make the hub any lighter. The USB hubs connect to host devices, such as smartphones, tablets, or laptops, through a limited set of connectors, which are usually 1 or 2. But all the weight of the adapter and connected cables/peripherals is supported by these limited set of connectors. Obviously, such a weight causes the adapter and connector to flex and often times disconnect from the host device. If the disconnection does not occur at first uses, it usually occurs over time gradually because the weight causes the connector plug's or socket's desired shape and dimension change so much that the connector gets loose from the host device's port.

Recently, the USB PD specification supported by USB-C ups the power delivery to 100 watts. It's also bi-directional, so a device can either send or receive power. And this power can be transferred at the same time the device is transmitting data across the connection. 100 watts power source and delivery could let you charge a laptop, which usually requires up to about 60 watts. Moreover, for the first time, USB-C connection could deliver audio data, and a USB-C port could potentially replace the 3.5 mm audio jack. For this technological advent, USB-C is the emerging standard for charging and transferring data, and new USB-C hubs provide even more ports for different connections. Thus, its weigh also increases. Apparently, it is desirable to have a new mechanism or method of attachment for a USB-C hub's connections to the limited set of ports of the mobile device such that the new mechanism or method will support the hub's weight and prevent the ports' and connectors' flexing problem. The need of a new attachment or connection mechanism is even more pronounced because the new USB-C port has a smaller shape and size and, thus, smaller surface for weight force distribution.

OBJECTIVE OF THE INVENTION

It is the object of this invention to create an attachment apparatus for securing a USB hub to a mobile device and preventing flexing of the port or connector due to the hub's weight.

It is the object of this invention to create said attachment apparatus which can be attach to or remove from a mobile device quickly without tools.

It is further the object of this invention to create a U-shape attachment apparatus that grips the side of a mobile device.

It is further the object of this invention to create an L-shape attachment apparatus that grips the side of a mobile device.

BRIEF DESCRIPTION OF THE DRAWINGS

These and other features and advantages of the invention will not be described with reference to the drawings of certain preferred embodiments, which are intended to illustrate and not to limit the invention, and in which.

SUMMARY OF THE INVENTION

In one aspect of the invention, an apparatus for securing a USB adapter hub to a mobile device that comprises a vertical plate, at least one set of top horizontal plate and bottom horizontal plate, the vertical plate and at least one set of top and bottom horizontal plates are fused together to form an elongated U-shape channel. The vertical plate comprises at least one through hole.

In one embodiment, the top horizontal plate extends out four times longer than the bottom horizontal plate.

In another embodiment, there are at least two screws for attaching the apparatus to a side of the USB adapter hub.

In another embodiment, there is at least one magnet for attaching the apparatus to a side of the USB adapter hub.

In another embodiment, the vertical plate comprises at least two sets of protruding tabs opposite the top and bottom horizontal plate, and the two sets of tabs have thickened bullnose edges.

In another embodiment, the vertical plate and the set of top and bottom horizontal plates are made of ABS plastic.

In another embodiment, the vertical plate and the set of top and bottom horizontal plates are made of steel.

In another embodiment, the vertical plate and the set of top and bottom horizontal plates are made of aluminum.

In another embodiment, the vertical plate further comprises at least two rounded lumps that fit two corresponding cavities on the side of the USB adapter hub.

In another embodiment, the apparatus is connected with an extension that comprises a USB connector at its far end.

In another embodiment, the set of top and bottom horizontal plates further comprise elongated shallow tabs running along the distant edges of the set of top and bottom horizontal plates.

DETAILED DESCRIPTION OF THE DRAWINGS

The invention will be described in the context of a preferred embodiment.

Figure 1:
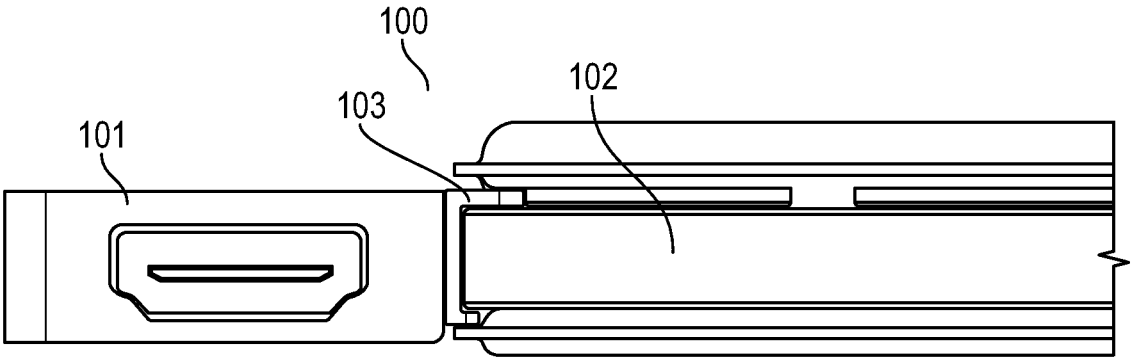
FIG. 1 illustrates an embodiment of this invention that attaches to the connector side of an adapter and grips the side of a mobile device.

FIG. 1 illustrates an embodiment 100 of this invention that is attached to the connector side of the USB adapter hub 101 and grips on the size of the mobile device 102. The depicted embodiment 100 comprises the USB hub 101 and a bracket 103 attaching to the connector side of the hub. It is appreciated that there are a variety of attachment methods to attach the bracket 103 to the side of the hub 101. The bracket 103 in this embodiment is made of machined aluminum for strength. It is appreciated at other materials could be used, such as steel, wood, ABS (Acrylonitrile Butadiene Styrene) plastic, etc. The bracket 103 comprises a wide vertical plate and two equally wide horizontal plates. The plates are fused together to form a U-shape channel bracket. When the U-shape bracket 103 is attached to the mobile device 102, the horizontal plates flex a little and grip the side of the mobile device 102, and this embodiment provides a rigid support for the weight of the hub 101.

Figure 2:
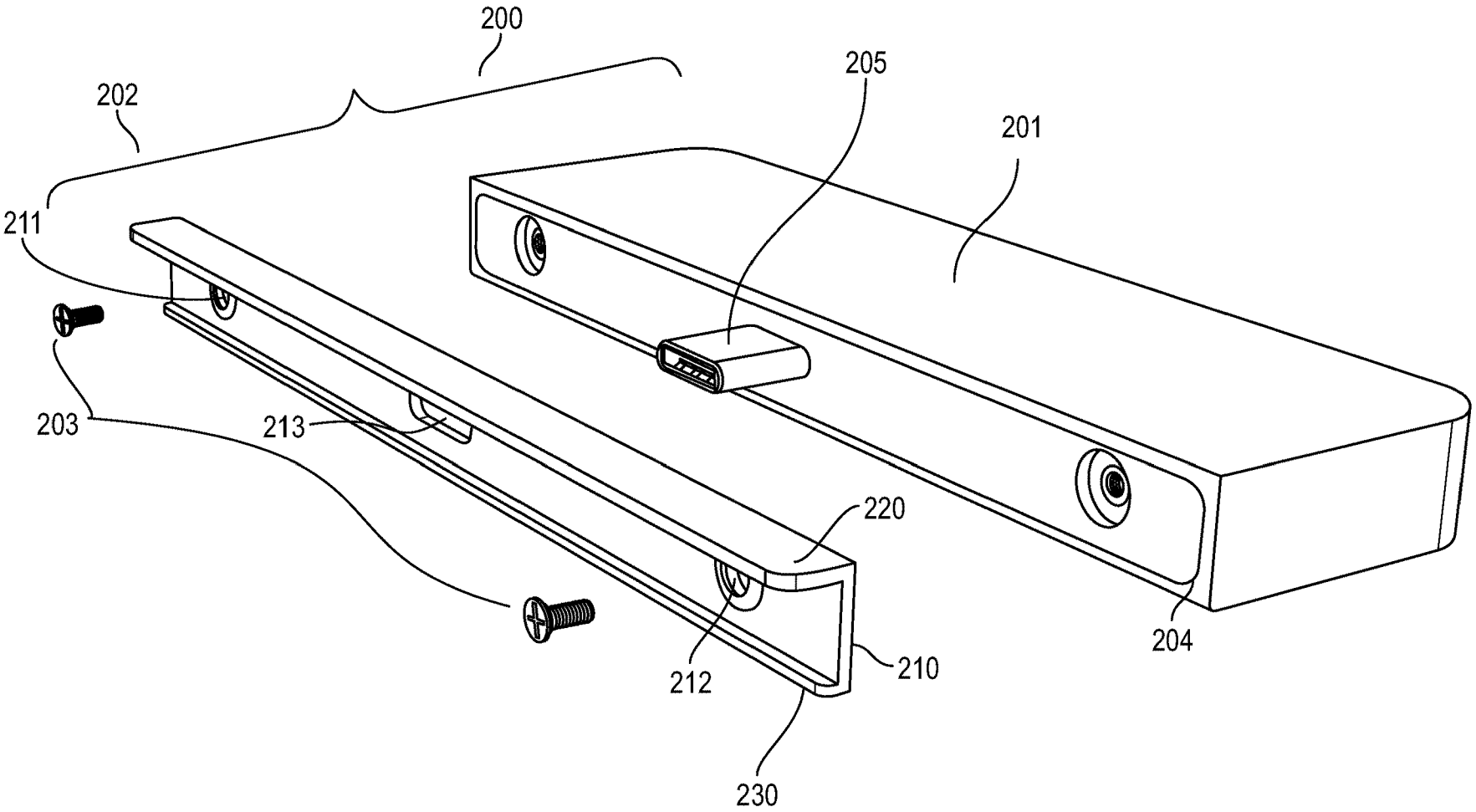
FIG. 2 illustrates an embodiment of this invention that is shown in an exploded view. This embodiment can either uses mechanical screws or slide-on attachment method, or both.

FIG. 2 illustrates an exploded view of an embodiment 200 of this invention. In this embodiment, a bracket 202 is to be attached to a USB adapter hub 201 with two screws 203. Besides screws, other methods of attachment are contemplated by the inventor, such as permanent adhesives, slide-on, etc. In this embodiment, the vertical plate 210 further comprises 3 through holes, 211, 212, and 213. Holes 211 and 212 allow the screws 203 go through so that they can mate with the nuts 204 on the side of the hub 201. Hole 213 allows the USB connector 205 of the hub 201 to go through so that it can plug in the USB port on the side of a mobile device. It is appreciated that although this exemplary embodiment is made of a see-through material, other materials can be used depending on the weight of the hub, and aesthetic and/or functional requirements of the users. In another embodiment, the distant edges of the horizontal plates 220 and 230 further comprise a thin and shallow tab running along the edges extending inward into the channel of the embodiment. The tabs help the embodiment grip better onto the side of the mobile device. It is appreciated that other mechanisms are contemplated by the inventor to increase the gripping force of the embodiment, such as temporary adhesive tapes.

Figure 3:
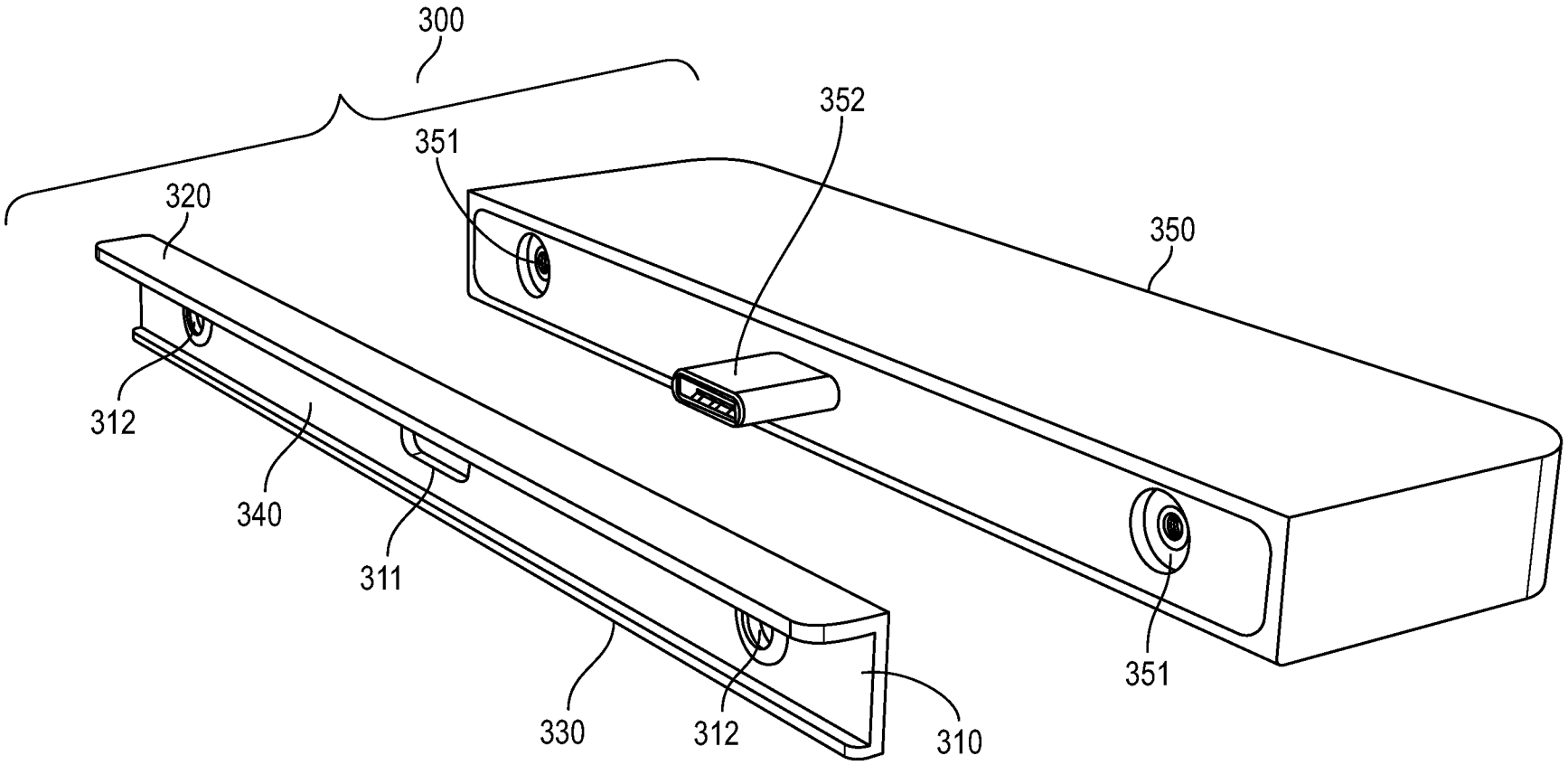
FIG. 3 illustrates an embodiment of this invention that is built into an adapter. The embodiment is built into the adapter as a part thereof.

FIG. 3 illustrates another embodiment 300 of this invention. This embodiment comprises a vertical plate 310, a top horizontal plate 320, and a bottom horizontal plate 330. The plates 310, 320, and 330 are fused together to form a channel 340. The horizontal plate 310 comprises an elongated oval-shape through hole 311 in the middle of the horizontal plate. The horizontal plate 310 further comprises two protruding rounded lumps 312 on the outer side of the channel 340. These two knobs 312, when the embodiment 300 is attached to the side of a USB hub 350, are snapped into two corresponding holes 351 on the side of the hub, and, as such, the embodiment 300 is attached to the USB hub 350. The through hole 311 allows the USB connector 352 of the USB hub through and disposed in the channel 340 of the embodiment, and, thus, the connector can plug in a USB port of a mobile device. When the USB hub plugs in the USB port of the mobile device, the horizontal plates 320 and 330 engage the top and bottom edges of the mobile device and support the weight of the whole assembly of the USB hub and this embodiment.

Figure 4:
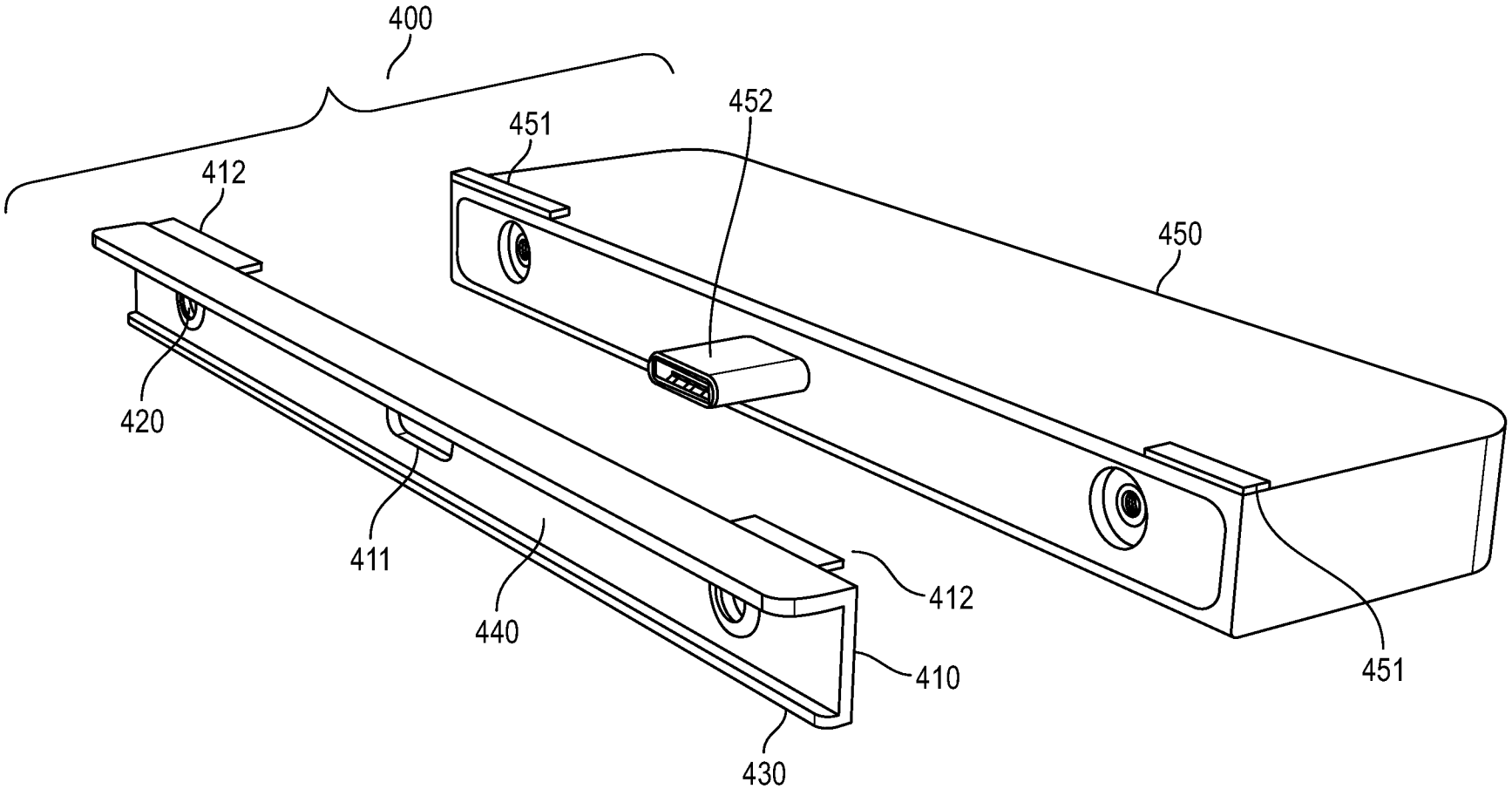
FIG. 4 illustrates other embodiments of this invention that are used with tablets.

FIG. 4 illustrates another embodiment 400 of this invention. This embodiment comprises a vertical plate 410, a top horizontal plate 420, and a bottom horizontal plate 430. The plates 410, 420, and 430 are fused together to form a channel 440. The horizontal plate 410 comprises an elongated oval-shape through hole 411 in the middle of the horizontal plate. The horizontal plate 410 further comprises two sets of flanges 412 on the outer side of the channel 440 at the opposite ends of the vertical plate 410. These two sets of flanges 412 have thicker bullnose edges that, when the embodiment 400 is being attached to the side of a USB hub 450, flex outward and slide on the top and bottom of the USB hub 450 toward the shallow trenches 451 and the thicker bullnose edges snap into the trenches 451, and, as such, the embodiment 400 is attached to the USB hub 450. The through hole 411 allows the USB plug 452 of the USB hub through and disposed in the channel 440 of the embodiment, and, thus, the plug can plug in a USB port of a mobile device. When the USB hub plugs in the USB port of the mobile device, the horizontal plates 320 and 330 engage the top and bottom edges of the mobile device and support the weight of the whole assembly of the USB hub and this embodiment.

Figure 5:
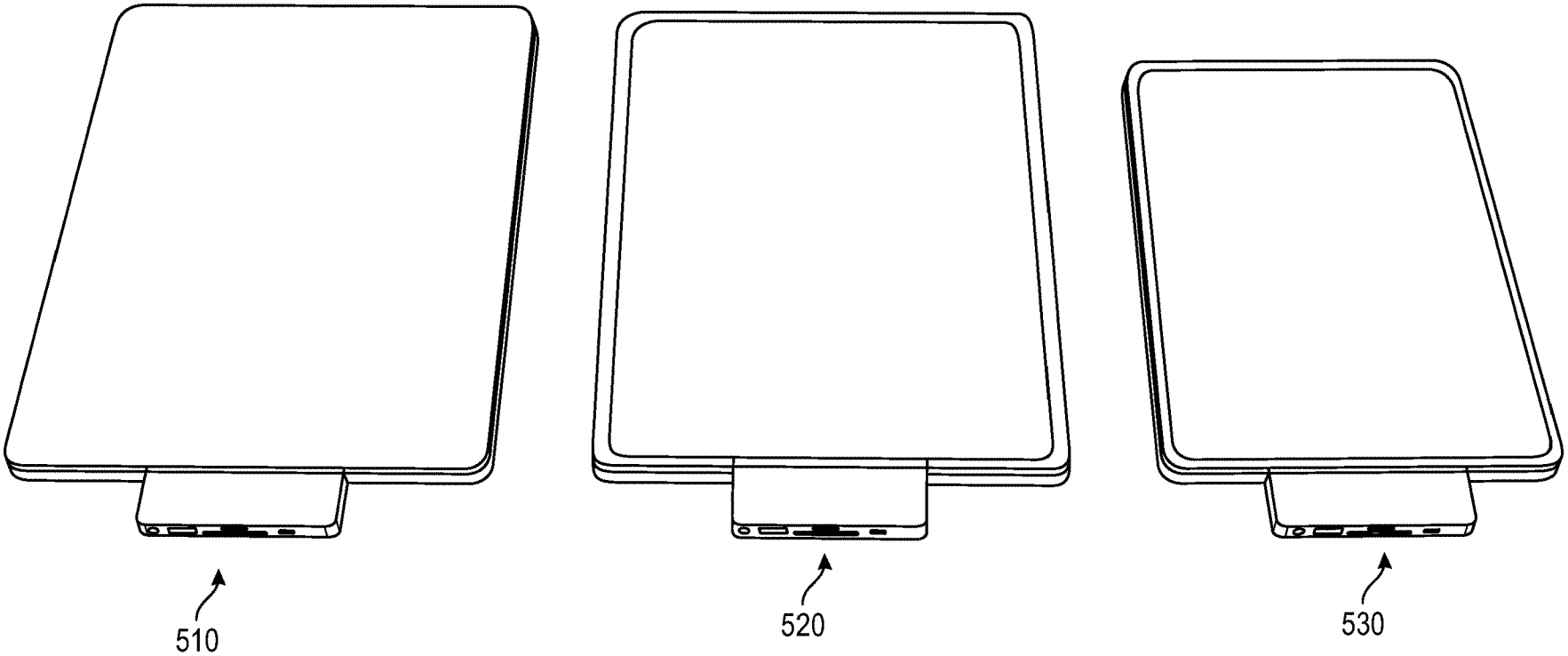
FIG. 5 illustrates an embodiment of this invention that is used with a laptop the front and side view of one embodiment of the present invention.

FIG. 5 illustrates other embodiments, 510, 520, and 530, of this invention where they are attached and used on tablets. The embodiments once secured and gripping on to the sides of the tablets they become parts and extensions of the tablets. They expand the functionalities of the tablets. The tablets now can send video data to a larger screen, audio data to loud speakers, transfer data forth and back among internal and external data storages. With this invention, compact sizes no longer limit the functionalities of the tablets.

Figure 6:
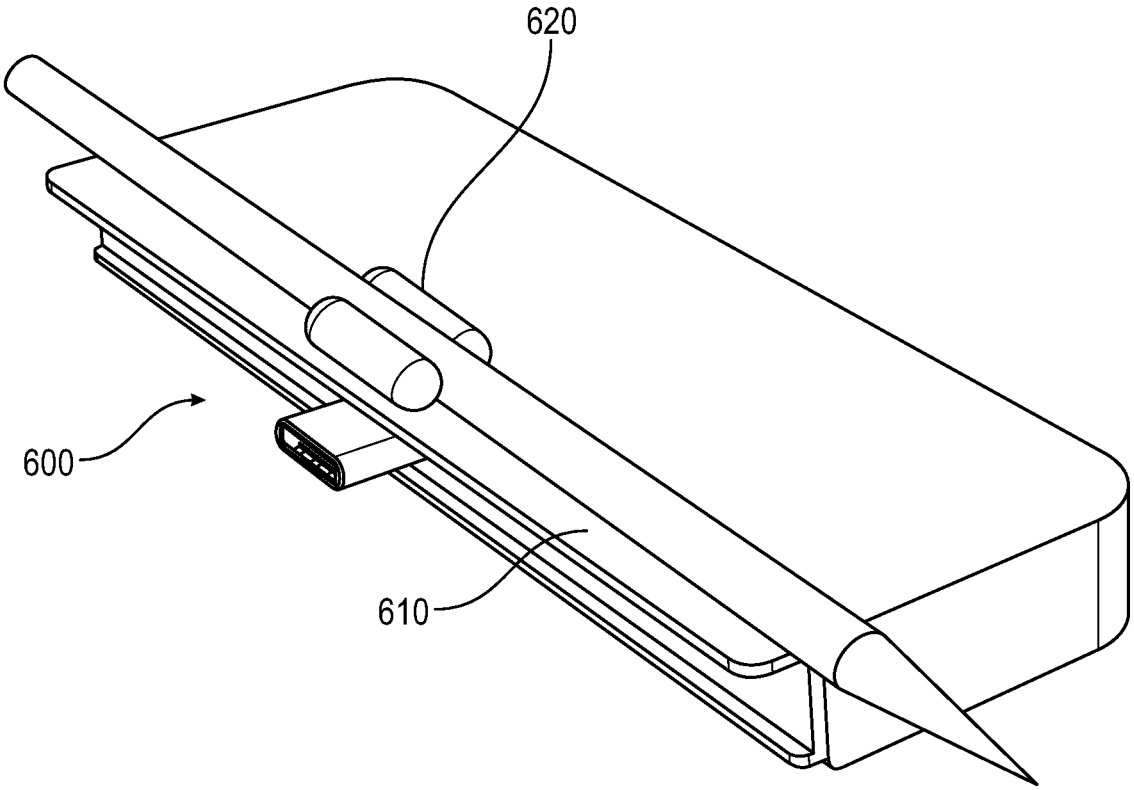
FIG. 6 illustrates other embodiments of this invention that are used with tablets.

FIG. 6 illustrates another embodiment 600 of this invention whereby the top plate 610 further comprises a stylus holder clip that comprises two elastic members 620 that flex outward when a stylus is inserted in the holder. As many users of mobile devices elect to use additional input devices other than their fingers, particularly "power" users who are likely to also be using the USB hub that this invention seeks to augment and improve, it would seem likely that many of them, particularly those that are using mobile tablets as illustrated in FIG. 5, are using a touch capacitive or other such enabled stylus device. As one of the inventions goals is to consolidate the number of different components and allow for a user to carry less, it so would seem that some device users are likely to desire and appreciate a mount that will hold their stylus and not require them to search around for it in bags, pockets, or the like. Further, as described above, it is considered that oftentimes with these mobile devices, the user may be restricted in mobility, such as a passenger on an airplane, and thus unable to access additional parts to a device because they are stowed, or in the alternative, as is being seen more in department stores and the like, it may be desirable to have the device and its components reduced to one mobile "unit" such that a roving cashier is not having to carry additional components to a device or is forced to seek them out.

Figure 7:
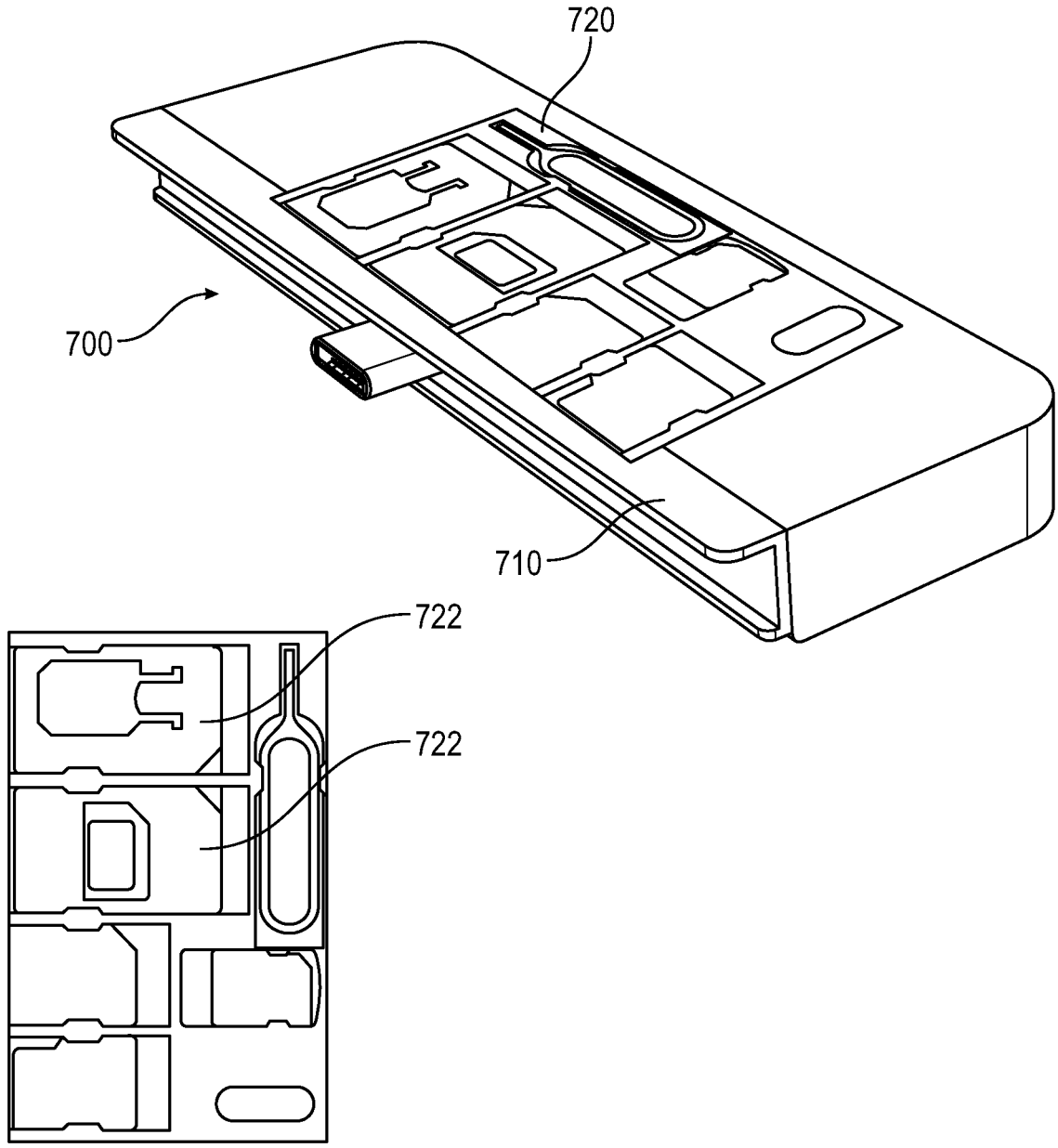
FIG. 7 illustrates other embodiments of this invention that are used with tablets.

FIG. 7 illustrates another embodiment 700 which now considers the addition, as with the stylus attachment, of a thin plate 720 that would rest across the surface of the top plate 710 of the USB hub. As one of the main purposes of these USB hubs is to enable additional data storage, or allow a user to transfer between data cards, it is contemplated that it may be desirable to incorporate a storage device so that a user of the invention might easily be able to access different data storage cards without being forced to go through laptop bags, pockets, and the like. Further, as indicated, this flush storage compartment considers the desire of users that might wish to swap out the SIM cards of their device, and includes storage that both allows for additional SIM cards as well as the micro-point tool that is primarily used these days to access the small compartment to swap the SIM cards out. To accommodate different electronic cards and their shapes and sizes, the thin plate 720 comprises multiple pockets 722 of different shapes and sizes.

Figure 8:
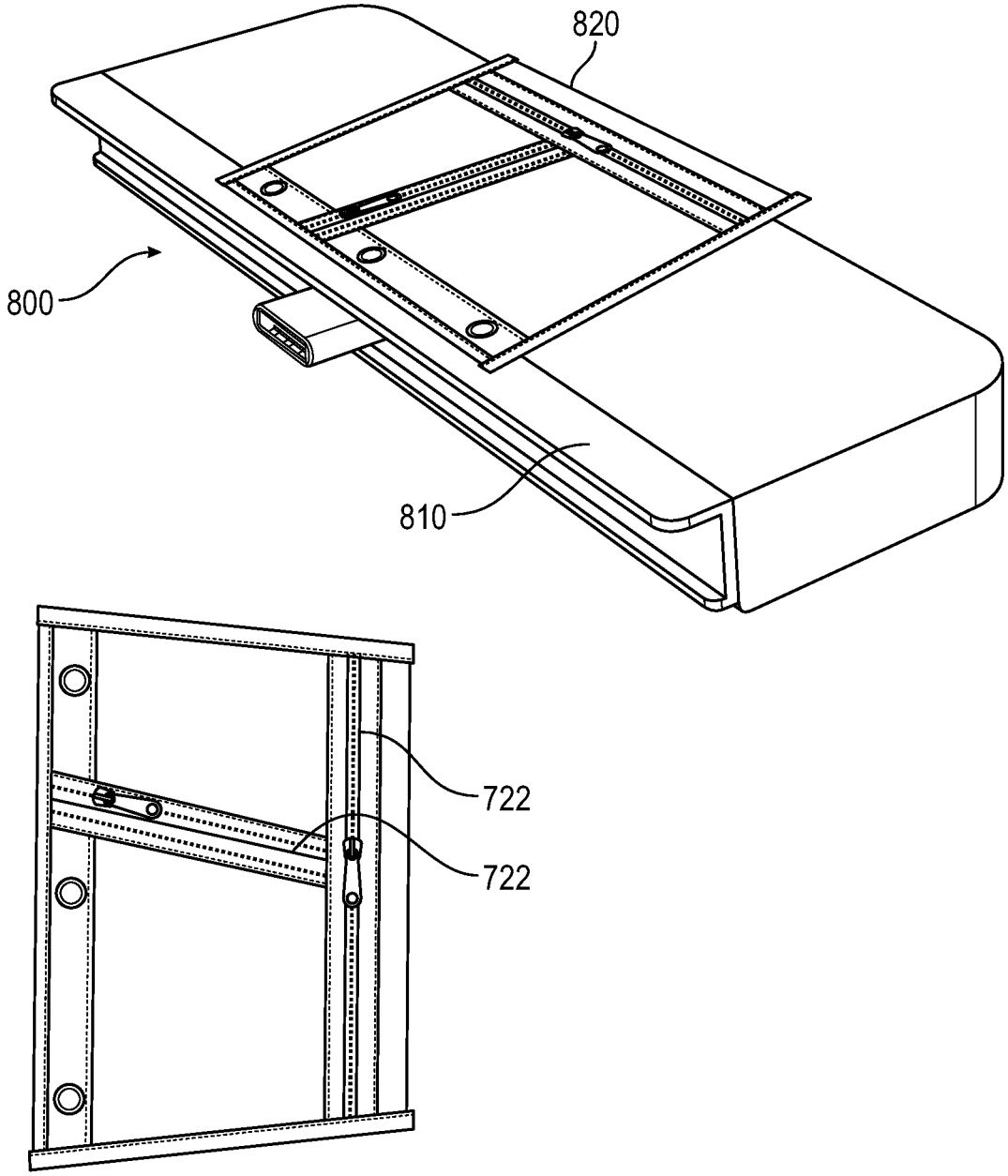
FIG. 8 illustrates other embodiments of this invention that are used with tablets.

FIG. 8 illustrates another embodiment 800 of the current invention that seeks to address an alternative form of storage that may be preferable to other users who seek additional storage space of other small items of their choosing, or perhaps earbud type headphones, or for users who have reservations about the card storage embodiment illustrated in FIG. 7 and would prefer storage that has sealed enclosures that can still be easily accessed. To address this demand, this embodiment comprises a bracket, as disclosed hereinabove, that comprises, among other components, a horizontal top plate 810, and a storage component 820 attached to the surface of the top plate 810. The storage components 820 further comprises pouches layered on top of each other and sealable by multiple zippers 822 of different sizes and shapes to accommodate the different pouches' openings. While somewhat less streamlined in appearance, such an embodiment still fulfills the overall goal of this invention maximizing economy of space and keeping items most important to a particular user of the device close at hand.

Figure 9:
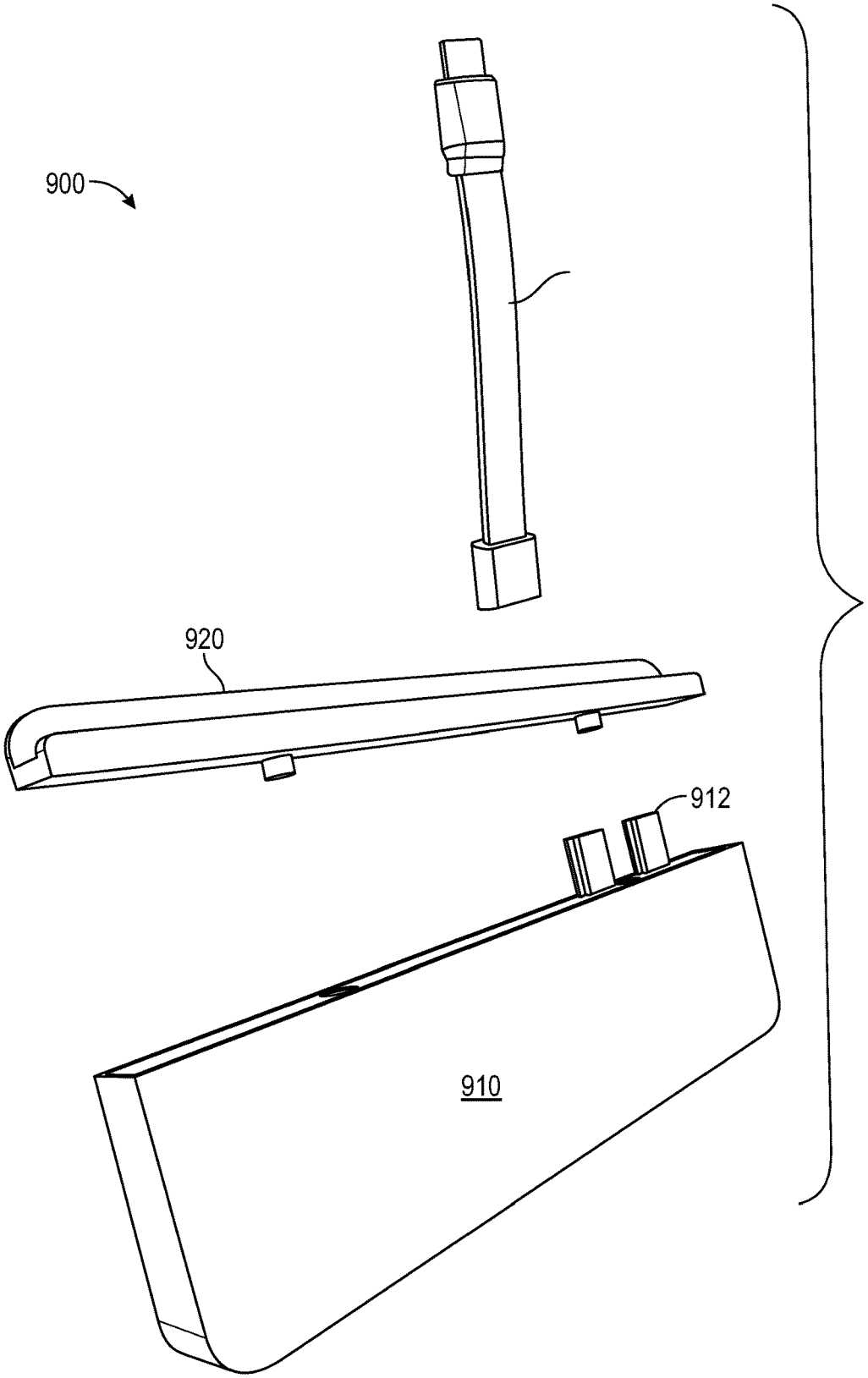
FIG. 9 illustrates another embodiment of this invention that comprises an extension.

FIG. 9 illustrates another embodiment 900 of the current invention which comprises a USB hub 910 that comprises two USB connectors 912, a bracket 920 as disclosed in FIGS. 1-4, and an extension 930 that in turn comprises an USB socket/port at the near end and a USB male connector at the far end that can connect with a computing device's USB port. In this embodiment, the bracket 920 is attached to the side of the adapter hub 910 where the USB connectors 912 are disposed. The bracket 920 comprises several through holes to expose the USB connectors 912. The USB socket on the near end of the extension 930 can connect with the exposed USB connector 912. When the far end of the extension 930 plugs in the computing device, the adapter hub's and its ports' connectivity is enabled.

Still referring to FIG. 9, it is appreciated that in another embodiment the USB socket at the near end of the extension 930 is fused to the bracket 920 and one of its through holes. When the bracket 920 is attached to the side of the adapter hub 910, the USB socket is also connected to one of the USB connector 912. Due to multiple attachment contacts, this embodiment improves the retention force of the extension 930 on the adapter hub 910 and, thus, prevents accidental detachment. It is also appreciated that the attachment method can be by means of screws received by the bracket 920 and adapter hub 910, or of the bracket 920's built-on clips that hold on to the adapter hub 910's edge on its top and at its bottom. The clips retention force can be further improved by corresponding thickened-tip clips and indents on the adapter near its edge.

Figure 10A:
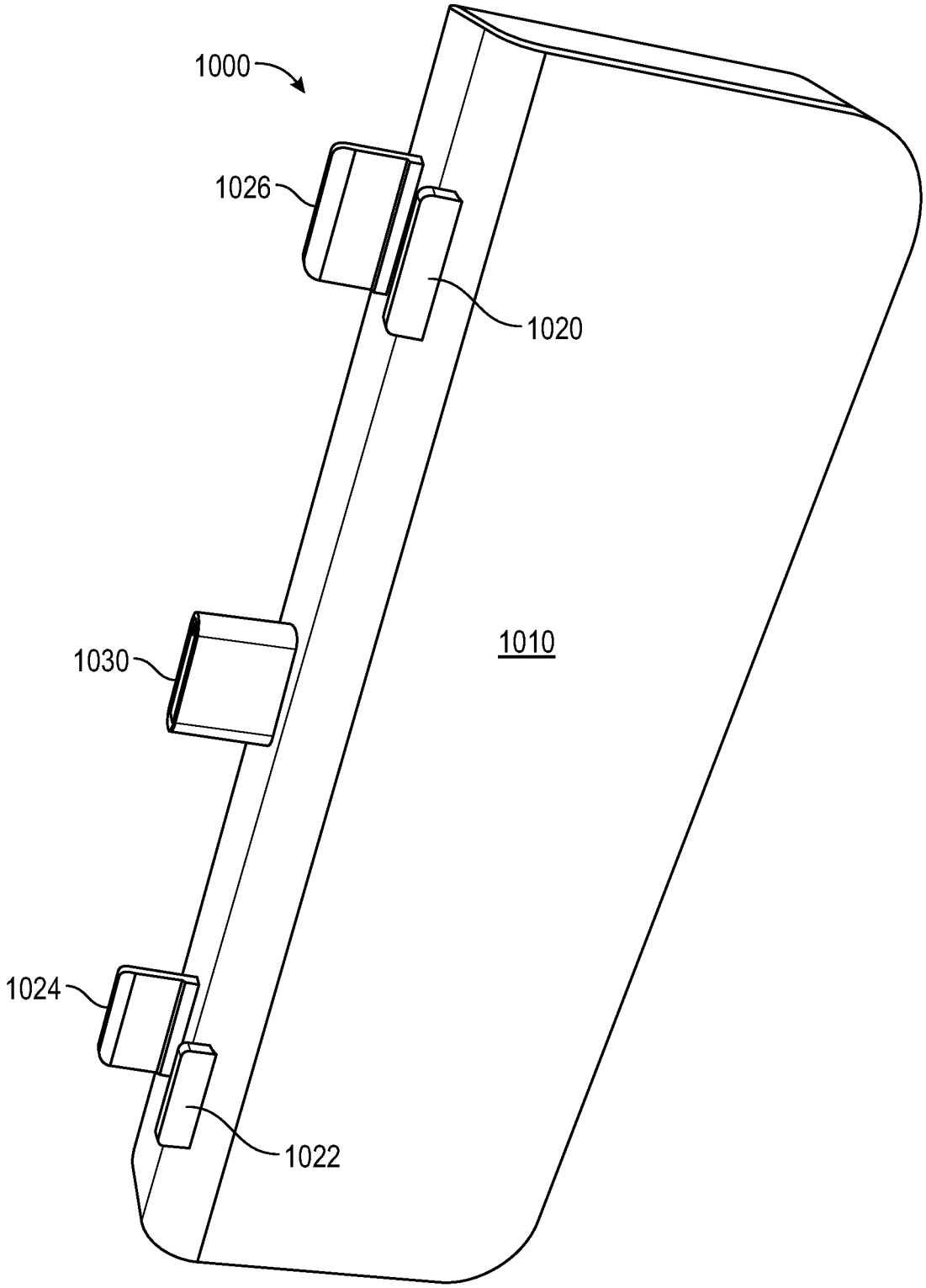
FIG. 10*a* illustrates another embodiment of this invention that comprises two sets of horizontal plates.
Figure 10B:
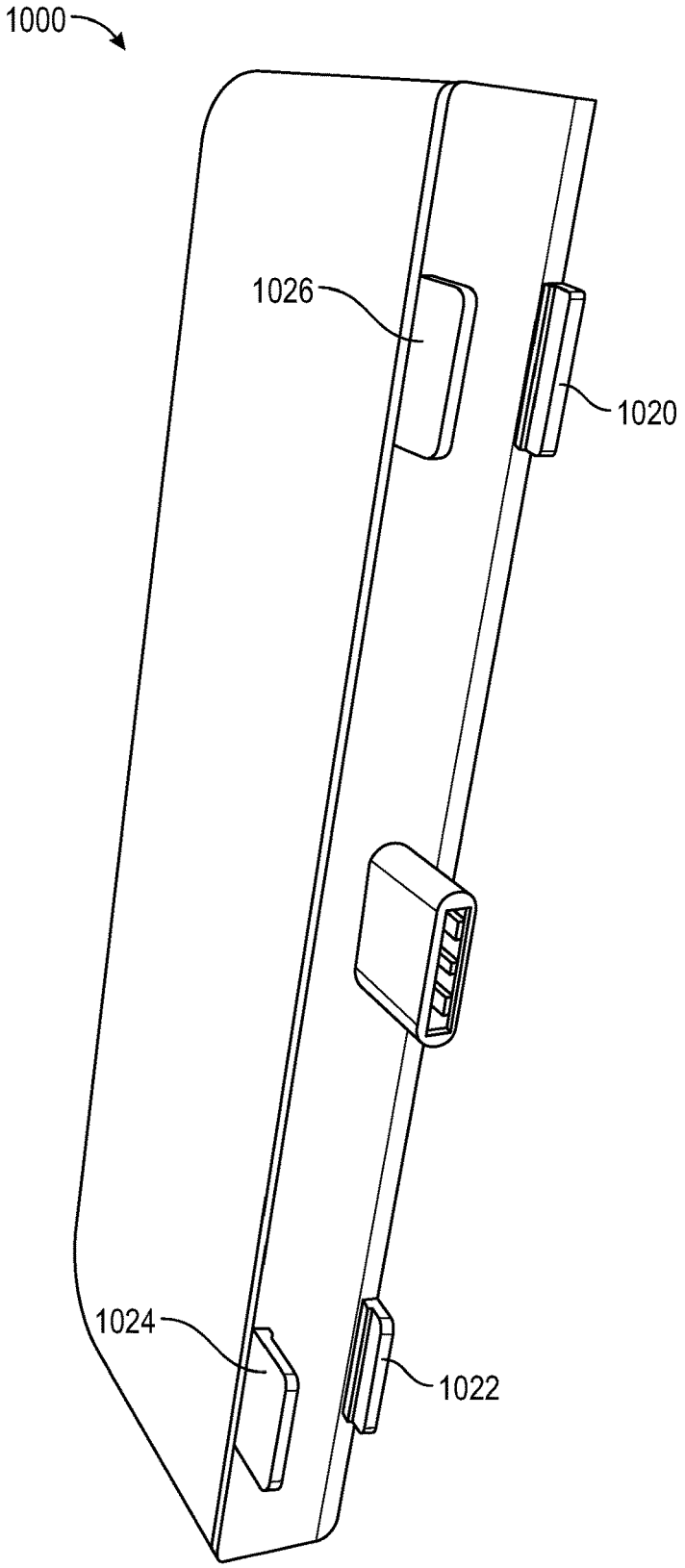
FIG. 10*b* illustrates another embodiment of this invention that comprises two sets of horizontal plates.

FIGS. 10*a* and 10*b* illustrate an embodiment 1000 of the current invention that comprises a housing 1010, on which four protruding tabs, 1020, 1022, 1024, 1026, are disposed. In this embodiment, the two top tabs, 1020 and 1022, are shorter than the bottom tabs, 1024 and 1026. In other embodiments, they can be of equal length. When this embodiment is in use, the tabs snap onto the edge of a mobile device and create a retention force while the USB connector 1030 is inserted into a mobile device's USB port. The combination of the snug-fit of the USB connector 1030 and the USB port, and the tabs' retention force secure this embodiment 1000 to the side of the mobile device.

FIG. 10*b* illustrates the embodiment 1000 from a different angle, and better illustrates the relative sizes and positions of the protruding tabs, 1020, 1022, 1024, 1026. Embodiments that support a USB-C connector can be used upside down due to the symmetrical nature of the USB-C port and connector.

Figure 11A:
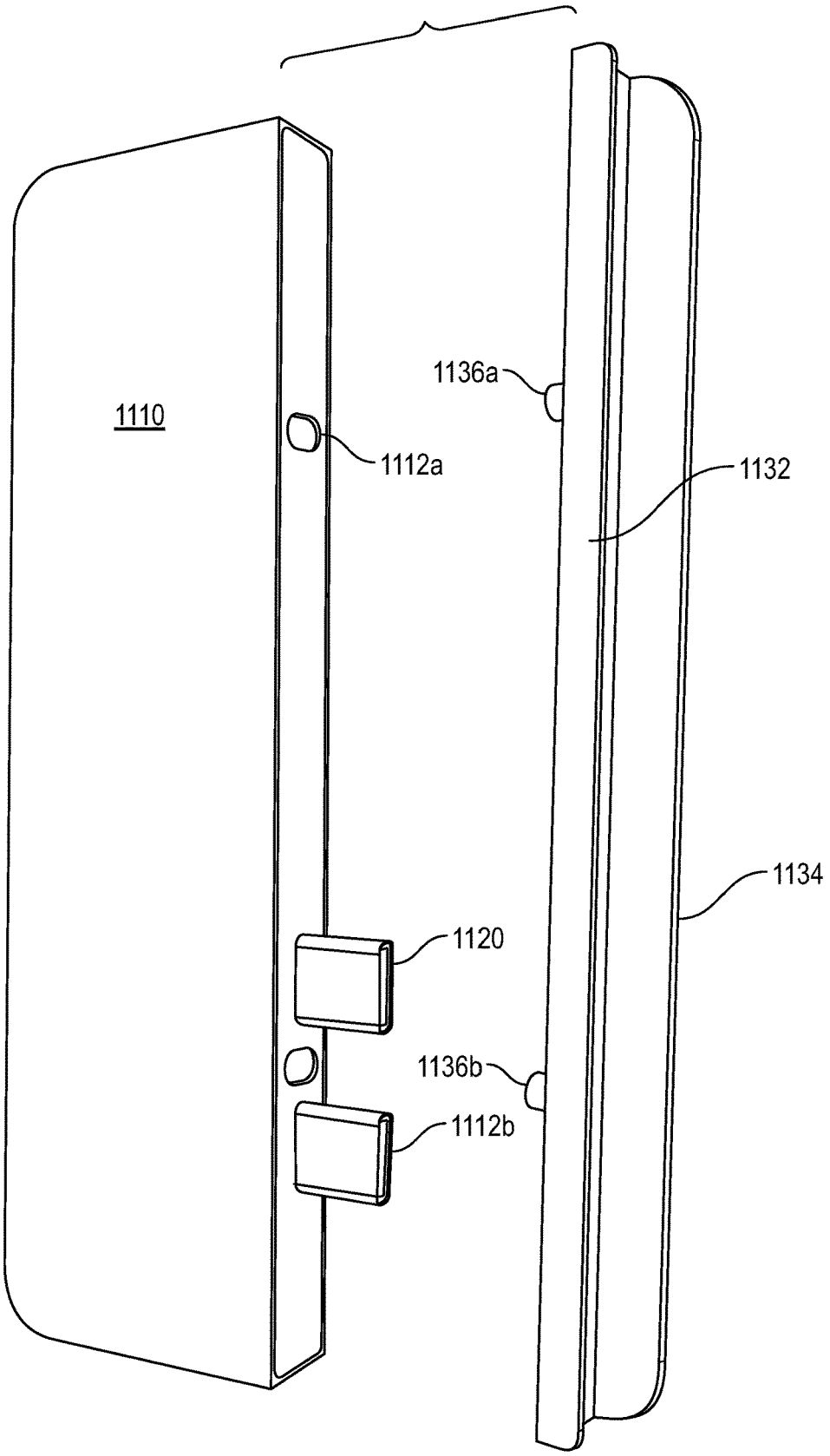
FIG. 11*a* illustrates another embodiment of this invention that comprises two openings for two USB connectors.
Figure 11B:
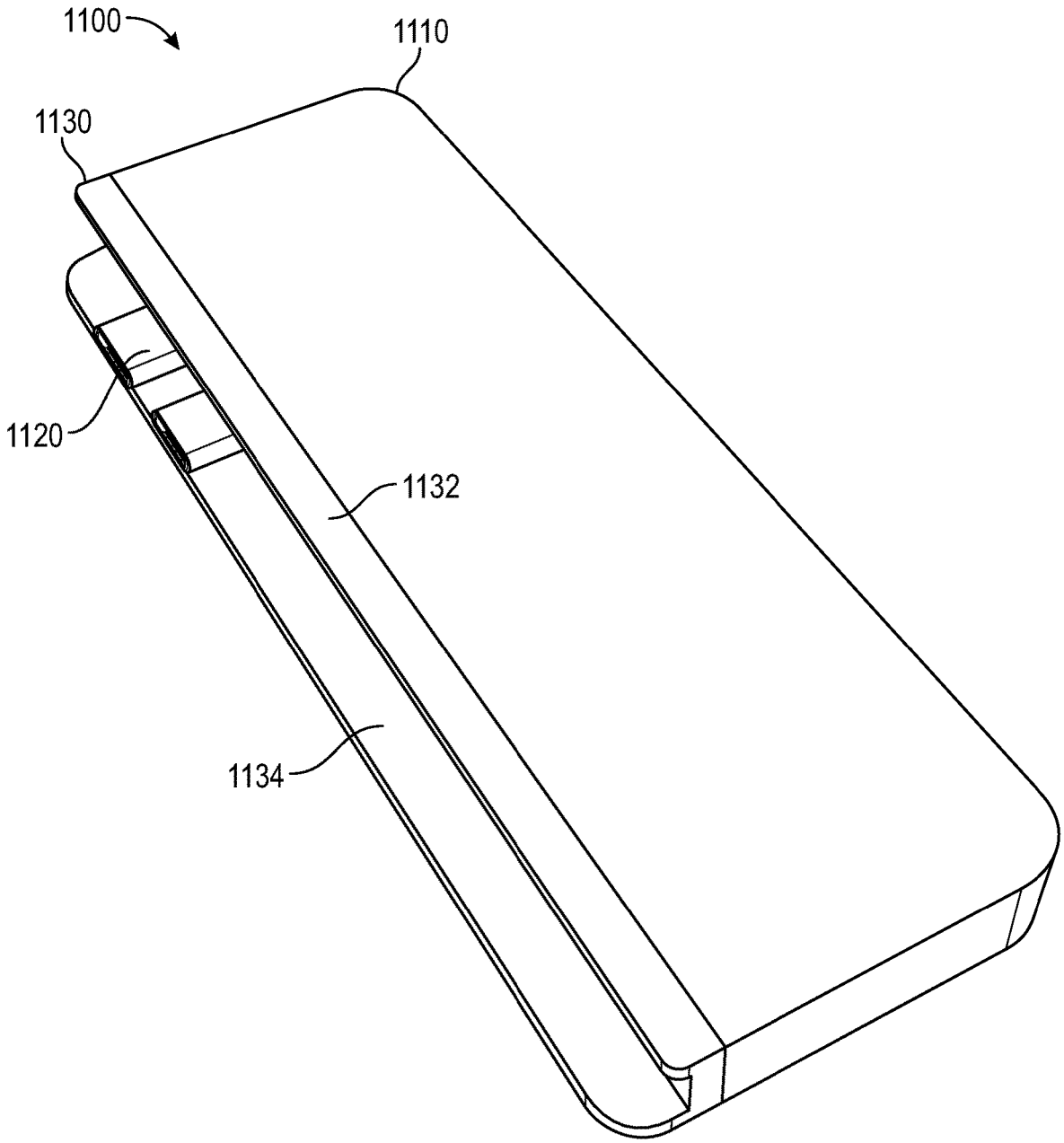
FIG. 11*b* illustrates another embodiment of this invention that comprises two openings for two USB connectors.

FIGS. 11*a* and 11*b* illustrate an embodiment 1100 of the current invention that comprises, among other internal components not shown, an USB hub housing 1110 that in turn comprises two cavities, 1112*a* and 1112*b*, disposed on the housing's side, and two USB connectors, 1120. This embodiment 1100 further comprises an elongated squared U-shape channel 1130 with a narrow plate 1132 and wider plate 1134. The U-shape channel 1130 can be as long as the hub housing 1110. The U-shape channel further comprises two protruding rounded lumps, 1136*a* and 1136*b*, that fit into the cavities, 1112*a* and 1112*b*, and are opened through to let two screws (not shown) through so that the screws can engage with the female threads inside those cavities. It is appreciated that strong magnates can be used in place of screws to attach the U-shape channel to the side of the housing 1110. In either case, the rounded lumps 1136*a* and 1136*b* are usually elastic so they can be tightly fit into the cavities 1112*a* and 1112*b*, and increase the attachment force. Although not shown, it is appreciated that the bottom plate of the U-shape channel comprises multiple openings that let the USB connectors 1120 through so that they can engage with USB ports on the side of a mobile device.

FIG. 11*b* illustrates the embodiment 1100 where the U-shape channel 1130 is attached to the side of the housing 1110 either by screws or magnets. The two USB connectors are disposed through openings on the bottom of the U-shape channel 1130, and can engage with a mobile device's USB ports once this embodiment is attached to edge of the mobile device. When attached, both narrow and wide plates, 1132 and 1134, flex a little, and the narrow plate 1132 is disposed on the top side of the mobile device's edge, and the wide plate 1134 on the bottom thereof. The U-shape channel contains the edge of the mobile device within its channel, and by gripping the edge of the mobile device, the narrow and wide plates retains the embodiment 1100 on the edge of the mobile device.

Figure 12:
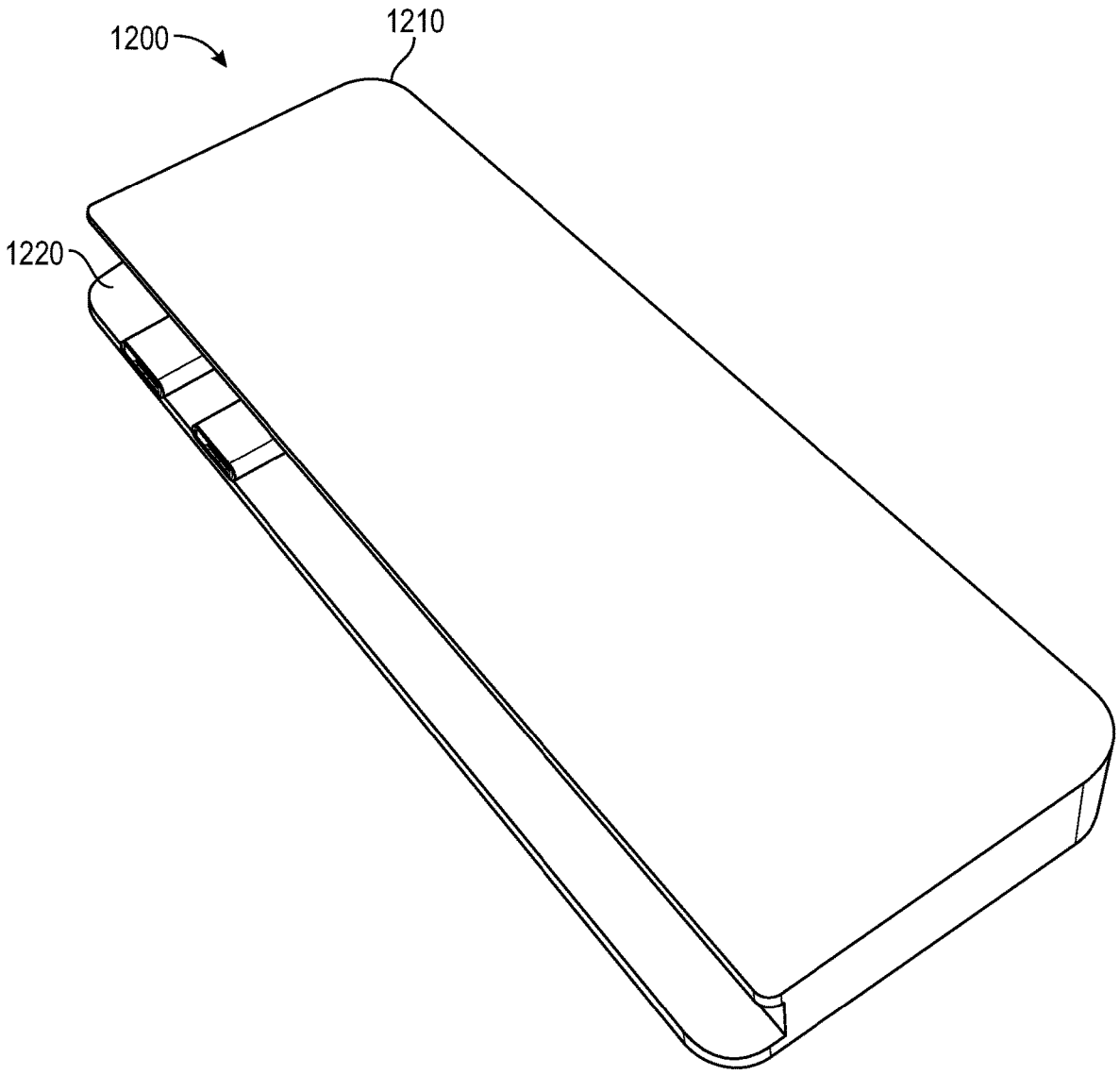
FIG. 12 illustrates another embodiment of this invention that has a bracket fused with the t uuuuuuadapter hub housing.

FIG. 12 illustrates another embodiment 1200 of the current invention that comprises a U-shape bracket 1220 that is fused to the adapter 1210's housing as one unit to strengthen the retention force of the whole embodiment, and reduce the component costs.

Figure 13:
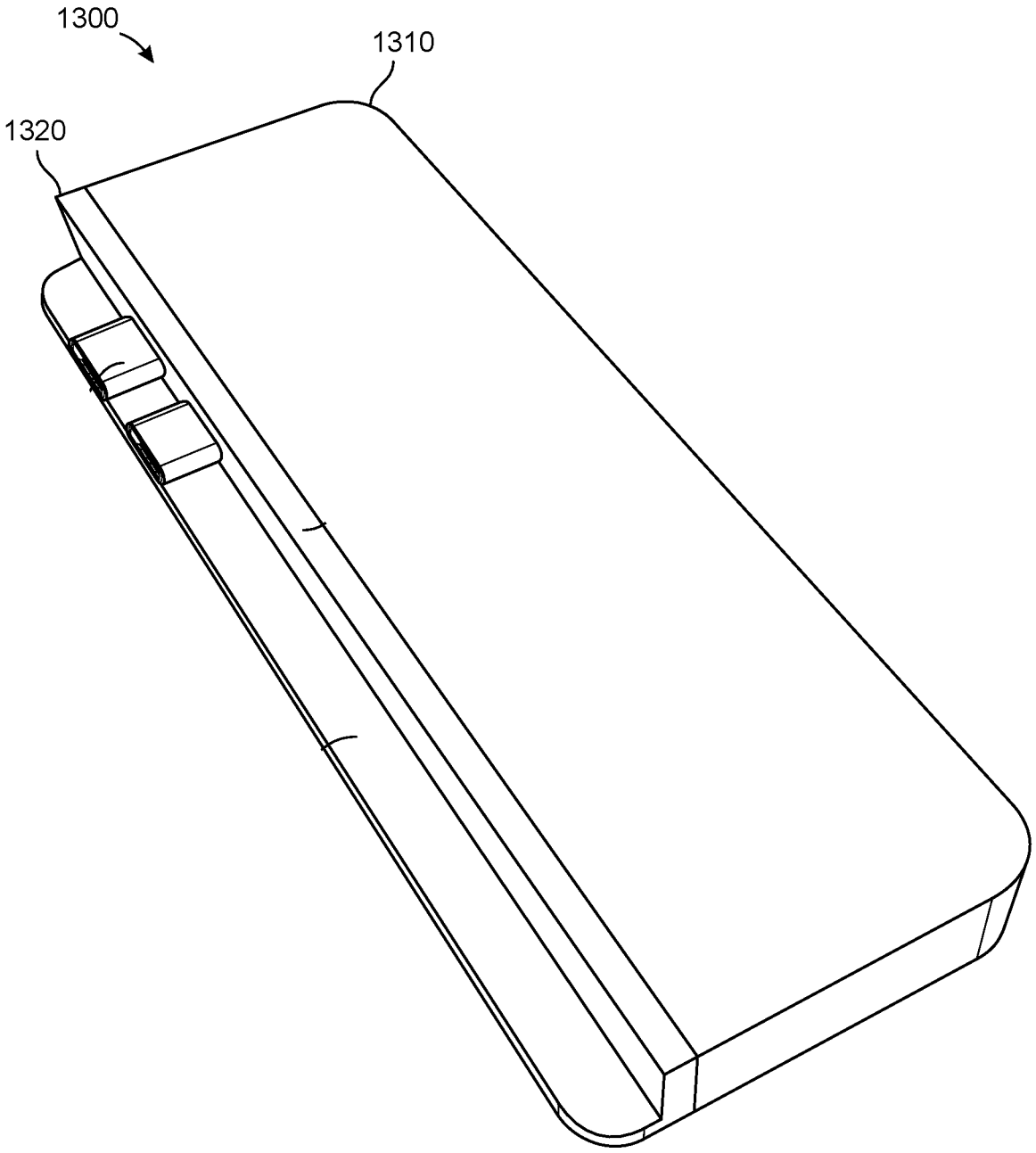
FIG. 13 illustrates another embodiment of this invention that has an L-shape bracket.

FIG. 13 illustrates another embodiment 1300 of the current invention that comprises a L-shape bracket 1320 that is attached to the adapter hub 1310's housing by the attachment methods disclose hereinabove. It is appreciated that in some embodiment the L-shape bracket 1320 can be fused to the adapter hub 1310's housing as one unit.

The invention claimed is:

1. An apparatus for securing a USB adapter hub to a mobile device comprising:

a vertical plate;

at least one set of a top horizontal plate and a bottom horizontal plate;

wherein said vertical plate and said top and bottom horizontal plates are fused together to form an elongated channel; wherein said vertical plate comprises at least one through hole;

one of at least two screws or at least one magnet for attaching said apparatus to a side of said USB adapter hub;

wherein one of said top and bottom horizontal plate further comprises at least one elongated bump disposed along a distant edge thereof.

2. The apparatus of claim 1, wherein said top horizontal plate extends out four times longer than said bottom horizontal plate.

3. The apparatus of claim 1, wherein said top horizontal plate or said bottom horizontal plate is nonexistent;

wherein said elongated channel is nonexistent; wherein said vertical and horizontal plates form an L-shape right angled bar.

4. The apparatus of claim 1, wherein said vertical plate further comprises at least one set of cantilever snap latches extending in opposite direction of said top and bottom horizontal plates; wherein said latches comprise bumps at distant ends; wherein said bumps face inward toward one another; wherein said USB adapter hub comprises grooves to receive said bumps and attach said apparatus thereto.

5. The apparatus of claim 1, wherein said vertical plate and said top and bottom horizontal plates are made of at least one of ABS plastic, steel, or aluminum.

6. The apparatus of claim 1, wherein said vertical plate further comprises at least two bumps that fit two corresponding cavities on a side of said USB adapter hub.

7. The apparatus of claim 1, wherein said apparatus is connected with an extension that comprises a USB connector at its far end.

8. A method for securing a USB adapter hub to a mobile device comprising:

providing a vertical plate;

providing a top horizontal plate and a bottom horizontal plate;

wherein providing said vertical plate and said top and bottom horizontal plates are fused together to form an elongated channel; wherein said vertical plate comprises at least one through hole;

providing one of at least two screws or at least one magnet for attaching said apparatus to a side of said USB adapter hub;

wherein one of said top and bottom horizontal plate further comprises at least one elongated bump disposed along a distant edge thereof.

9. The method of claim 8, wherein said top horizontal plate extends out four times longer than said bottom horizontal plate.

10. The apparatus of claim 8, wherein said top horizontal plate or said bottom horizontal plate is nonexistent; wherein said elongated channel is nonexistent; wherein said vertical plate and said existent horizontal plate form an L-shape right angled bar.

11. The method of claim 8, wherein said vertical plate further comprises at least one set of cantilever snap latches extending in opposite direction of said top and bottom horizontal plates; wherein said latches comprise bumps at distant ends; wherein said bumps face inward toward one another; wherein said USB adapter hub comprises grooves to receive said bumps and attach said apparatus thereto.

12. The method of claim 8, wherein said vertical plate and said top and bottom horizontal plates are made of at least one of ABS plastic, steel, or aluminum.

13. The method of claim 8, wherein said vertical plate further comprises at least two bumps that fit two corresponding cavities on a side of said USB adapter hub.

14. The method of claim 8 further providing an extension that is connected to said vertical plate and comprises a USB connector at its far end.

* * * * *